US006439517B1

(12) United States Patent
Applegate

(10) Patent No.: US 6,439,517 B1
(45) Date of Patent: Aug. 27, 2002

(54) APPARATUS FOR HOLDING A TRASH RECEPTACLE

(76) Inventor: Robert L. Applegate, 2008 Melholland, Lawrence, KS (US) 66047

( * ) Notice: Subject to any disclaimer, the term of this patent is extended or adjusted under 35 U.S.C. 154(b) by 0 days.

(21) Appl. No.: 09/818,098

(22) Filed: Mar. 27, 2001

(51) Int. Cl.[7] ..... A47G 23/02
(52) U.S. Cl. ..... 248/154; 248/907
(58) Field of Search ..... 248/154, 907, 248/146, 312.1, 316.4; 211/85.29

(56) References Cited

U.S. PATENT DOCUMENTS

| | | | | | |
|---|---|---|---|---|---|
| 3,212,743 | A | * | 10/1965 | Culver | 248/312.1 |
| 3,315,817 | A | * | 4/1967 | Hook | 211/85.19 |
| 3,498,576 | A | * | 3/1970 | Alissandratos | 211/107 |
| 3,589,658 | A | * | 6/1971 | Kopfman | 248/146 |
| 3,638,802 | A | | 2/1972 | Westerfield | |
| 3,642,145 | A | | 2/1972 | Shelton | |
| 3,666,223 | A | | 5/1972 | Moore | |
| 3,675,783 | A | | 7/1972 | Reese | |
| 3,892,315 | A | | 7/1975 | Johnson | |
| 4,113,214 | A | * | 9/1978 | Dubois | 248/146 |
| 4,184,659 | A | | 1/1980 | Abrahamson | |
| 4,191,297 | A | * | 3/1980 | Hardman | 248/907 |
| 4,513,938 | A | | 4/1985 | Seymour | |
| 4,559,747 | A | | 12/1985 | Engel | |
| 4,860,909 | A | * | 8/1989 | Leumi | 248/907 |
| 5,213,294 | A | | 5/1993 | DeBord | |

* cited by examiner

*Primary Examiner*—Ramon O. Ramirez
(74) *Attorney, Agent, or Firm*—Dale J. Ream

(57) ABSTRACT

An apparatus for holding and supporting a trash receptacle includes a first collar that may be slidably coupled to a support post and may be selectively frictionally tightened thereto with a threaded screw fastener. A downwardly opening clip is attached to the first collar for capturing the upper rim of the trash receptacle. The apparatus includes a second collar which may be slidably coupled to the support post below the first collar and selectively frictionally tightened thereto. An L-shaped bracket is attached to the second collar and includes an annular configuration for supporting and engaging a lower rim of a trash receptacle.

11 Claims, 4 Drawing Sheets

24
16
22
20
12
18

6
40
32
36

28
30
26
12
6
40

32
34
42
46
44

APPARATUS FOR HOLDING A TRASH RECEPTACLE

BACKGROUND OF THE INVENTION

This invention relates generally to holding devices for trash receptacles and, more particularly, to a universal apparatus for adjustable attachment to a support post for supporting and capturing a trash receptacle which prevents the receptacle from being tipped over or removed.

Various devices have been proposed for holding garbage, refuse, or trash containers. Existing devices are typically constructed for use with trash cans having a particular size and design or that do not preclude unauthorized removal of a held trash container.

Therefore, it is desirable to have an apparatus in which attachment flanges are slidably adjustable along a support post such that the apparatus may be selectively used with trash receptacles of various configurations and such that a held receptacles may not be easily removed from the apparatus.

SUMMARY OF THE INVENTION

An apparatus for holding a trash receptacle according to the present invention includes first and second collars that may be coupled to an upstanding support post for slidable movement therealong. Each collar defines a bore having threads which mate with respective screw fasteners such that the collars may be frictionally tightened and secured at user-selected positions along the support post. Preferably, the first collar is positioned above the second collar. A generally inverted U-shaped clip is fixedly attached to the first collar for capturing an upper rim of a trash receptacle. An L-shaped annular bracket is fixedly attached to the second collar for engaging and support a lower rim of the trash receptacle. When the trash receptacle is properly supported atop the bracket and captured by the clip, the receptacle cannot be removed therefrom.

Therefore, a general object of this invention is to provide an apparatus for supporting a trash receptacle above the ground that prevents the receptacle from being easily tipped over.

Another object of this invention is to provide an apparatus, as aforesaid, which includes a pair of collars that are slidably adjustable along a support post for supporting and capturing trash receptacles of different sizes and configurations.

Still another object of this invention is to provide an apparatus, as aforesaid, which is not easily tipped over or removed when the collars are frictionally tightened to the support post.

A further object of this invention is to provide an apparatus, as aforesaid, which includes a cap member which precludes unauthorized removal of the collars from a support post.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
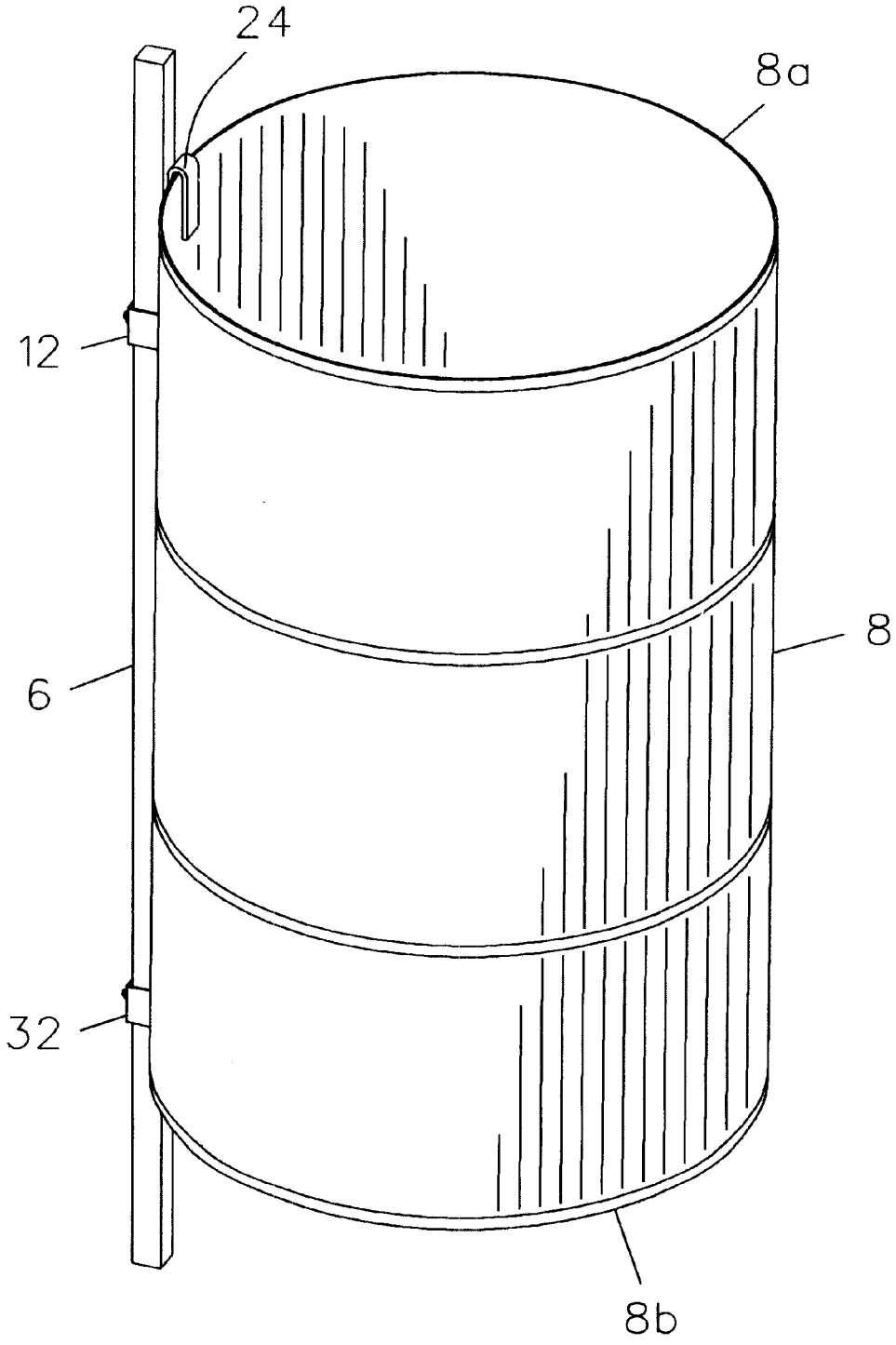
FIG. 1 is a perspective view of an apparatus for holding a trash receptacle according to a preferred embodiment of the present invention.
Figures 2A, 2B, 2C, 2D:
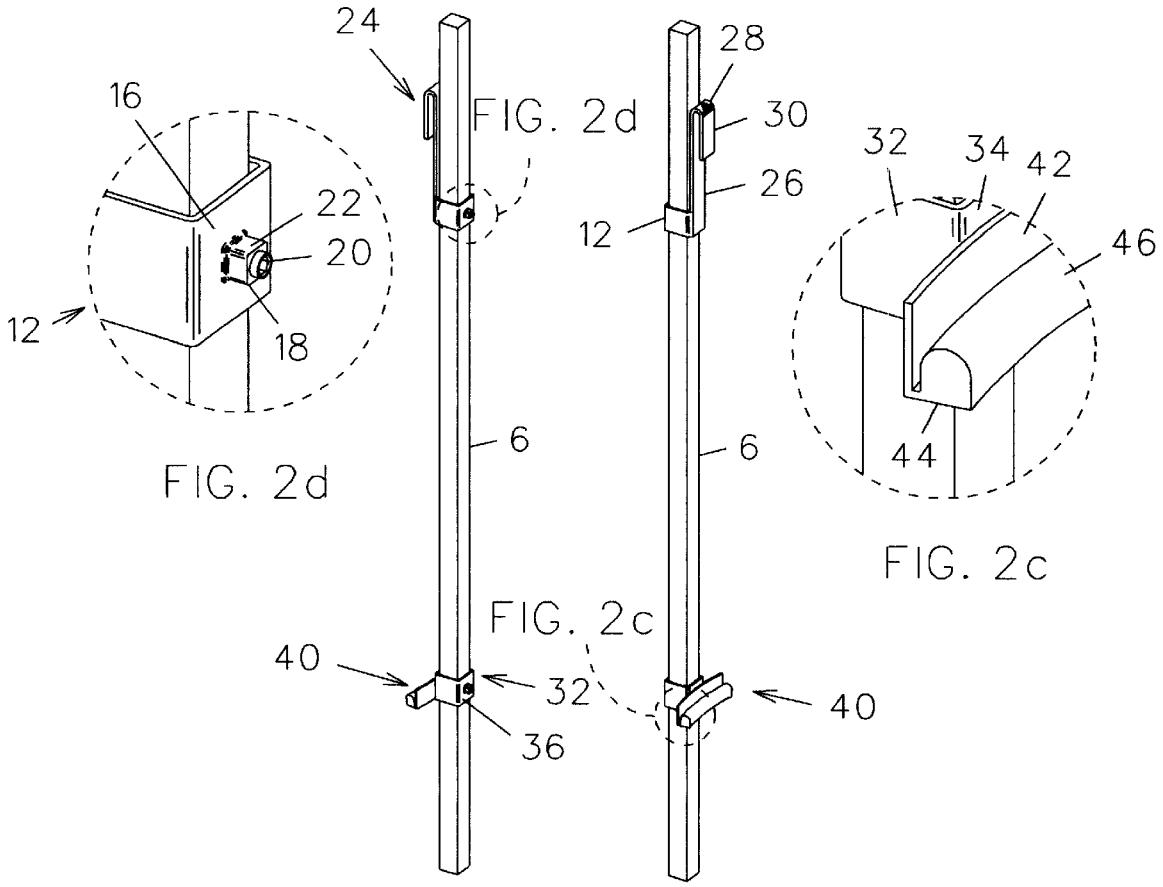
FIG. 2*a* is a rear perspective view of the apparatus as in FIG. 1 with the trash receptacle removed.
FIG. 2*b* is a front perspective view of the apparatus as in FIG. 2*a;*
FIG. 2*c* is a fragmentary view on an enlarged scale of the bracket as in FIG. 2*b;*
FIG. 2*d* is a perspective view on an enlarged scale of the bore and screw fastener of the first collar as in FIG. 2*a;*

An apparatus for supporting and holding a trash receptacle according to the present invention will be described in detail along with FIGS. 1 through 4 of the accompanying drawings. An apparatus 10 according to one embodiment of the invention is shown in FIGS. 1 and 2 and includes first 12 and second 32 collars, also referred to as clamps. The first collar 12 includes four side walls connected in a square configuration suitable for being coupled to a square support post 6 and slidable therealong (FIG. 2*b*). In use, the second collar 32 should be positioned below the first collar 12, as will be further described below. The first collar 12 defines a first bore 18 through a rear wall 16 thereof (FIG. 2*d*), the bore being threaded therein (not shown). The apparatus 10 further includes a screw fastener 20 having threads which mate with the threads within the bore 18 for frictionally tightening the first collar 12 at a user-selected position along the support post 6. Preferably, the screw fastener 20 is a set screw although the bore may be configured for receiving an Allen wrench. In addition, a hex nut 22 or the like may be fixedly attached to the rear wall 16 of the first collar 12 through which the bore extends so as to lengthen the bore itself (FIG. 2*d*).

It is understood that the first 12 and second 32 collars may include round, rectangular, or some other configuration suitable to be slidably coupled to support posts having corresponding configurations. The first 12 and second 32 collars may also be configured to be coupled to any support post having a conventional configuration.

A downwardly opening clip 24 is fixedly attached to a front wall of the first collar 12. More particularly, the clip 24 includes an inverted U-shaped configuration having first 26 and second 30 portions with an angular portion 28 connecting the first 26 and second 30 portions (FIG. 2*b*). The first portion 26 extends upwardly from the first collar 12 and includes a length greater than a length of the second portion 30, the second portion 30 extending downwardly from the angular portion 28. The first 26 and second 30 portions are spaced apart sufficiently to capture the upper rim 8*a* of a trash receptacle 8 therebetween.

The second collar 32 includes four side walls connected in a square configuration suitable for being coupled to a square support post 6 and slidable therealong (FIG. 2*b*). Having a construction substantially similar to that of the first collar 12, a rear wall 36 of the second collar 32 defines a threaded bore adapted to receive a screw fastener therein for tightening or clamping the second collar 32 to the support post 6 (FIG. 2*a*). A hex nut or other similar flange may also be fixedly attached to the rear wall 36 of the second collar 32 so as to lengthen the bore through the rear wall 36.

A generally L-shaped bracket 40 having an annular lateral configuration is fixedly attached to a front wall 34 of the second collar 32 (FIG. 2*b*). The bracket 40 is preferably constructed of angle iron although an integrally molded plastic construction would also work. The bracket 40, also referred to as a platform member, includes an annular rear wall 42 (FIG. 2*c*) for bearing against and supporting a side wall of a trash receptacle 8. The bracket 40 further includes an annular bottom wall 44 which acts as a platform for supporting the lower rim of a trash receptacle 8 thereon. A rounded bar member 46 is fixedly attached to the bottom wall 44 along an outer edge thereof and displaced slightly from the rear wall 42 (FIG. 2*c*). This configuration enables a mating engagement between the bracket 40 and trash receptacles having a recessed lip configuration, such as barrel-type receptacles.

In use, a support post 6 is mounted in a ground surface for upward extension therefrom (FIG. 1). The second collar 32 is coupled to the support post 6 by a user sliding it over the top thereof and sliding it down to a desired position. This will be the position a trash receptacle 8 may be supported above the ground. The second collar 32 may be tightened and secured to the support post 6 by engaging a screw fastener into the second collar bore. The first collar 12 may then be slidably coupled to the support post 6 in like manner, although it should not be completely tightened thereto until a trash receptacle 8 has been positioned and captured. The lower rim 8*b* of a trash receptacle 8 may be positioned upon and in engagement with the bracket 40 of the second collar 32 and the clip 24 of the first collar 12 may be moved downwardly until the upper rim 8*a* of the trash receptacle 8 has been captured. Then the first collar may be tightened with the screw fastener 20 and bore 18 arrangement.

Figure 3:
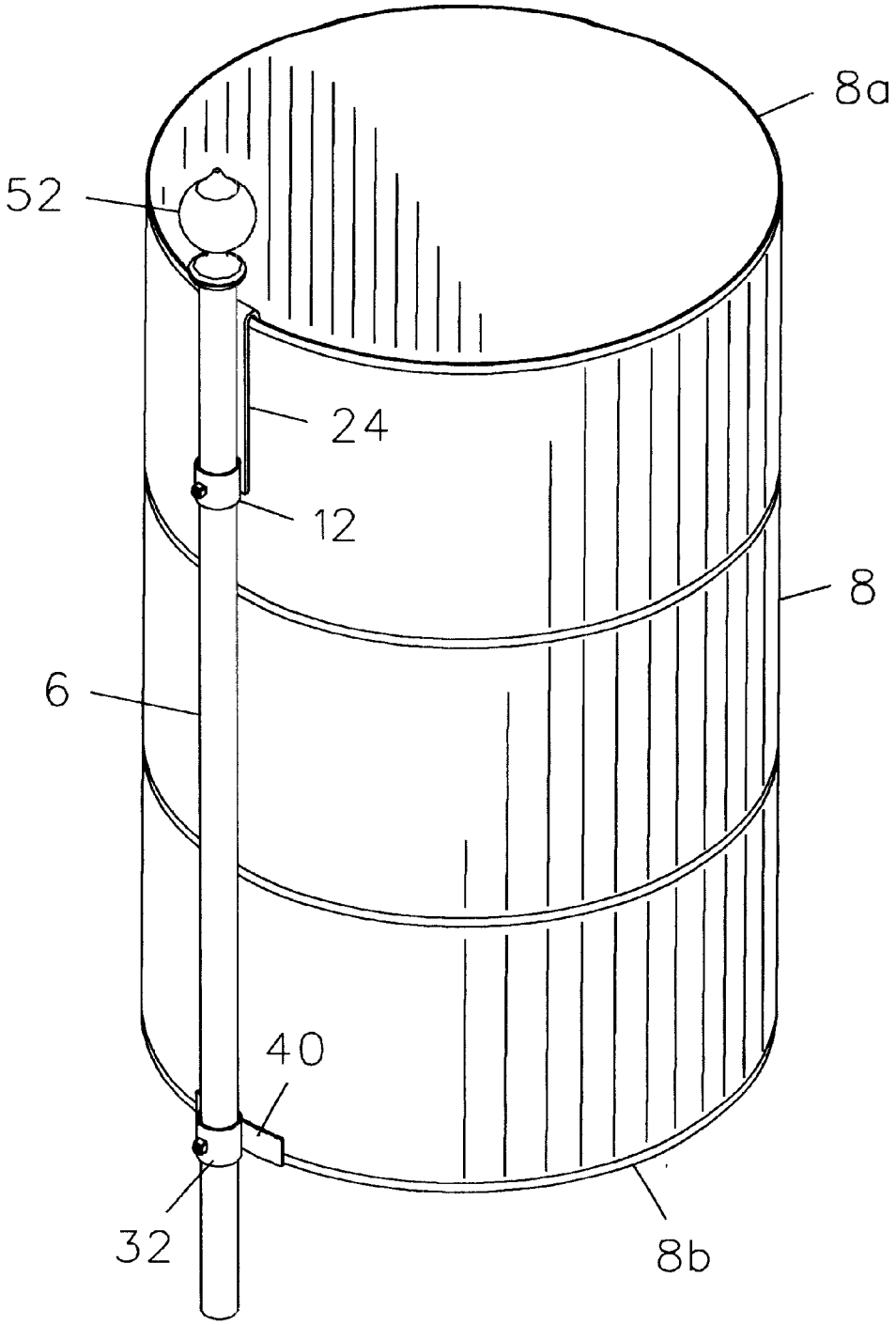
FIG. 3 is a perspective view of an apparatus for holding a trash receptacle according to another embodiment of the present invention.
Figure 4:
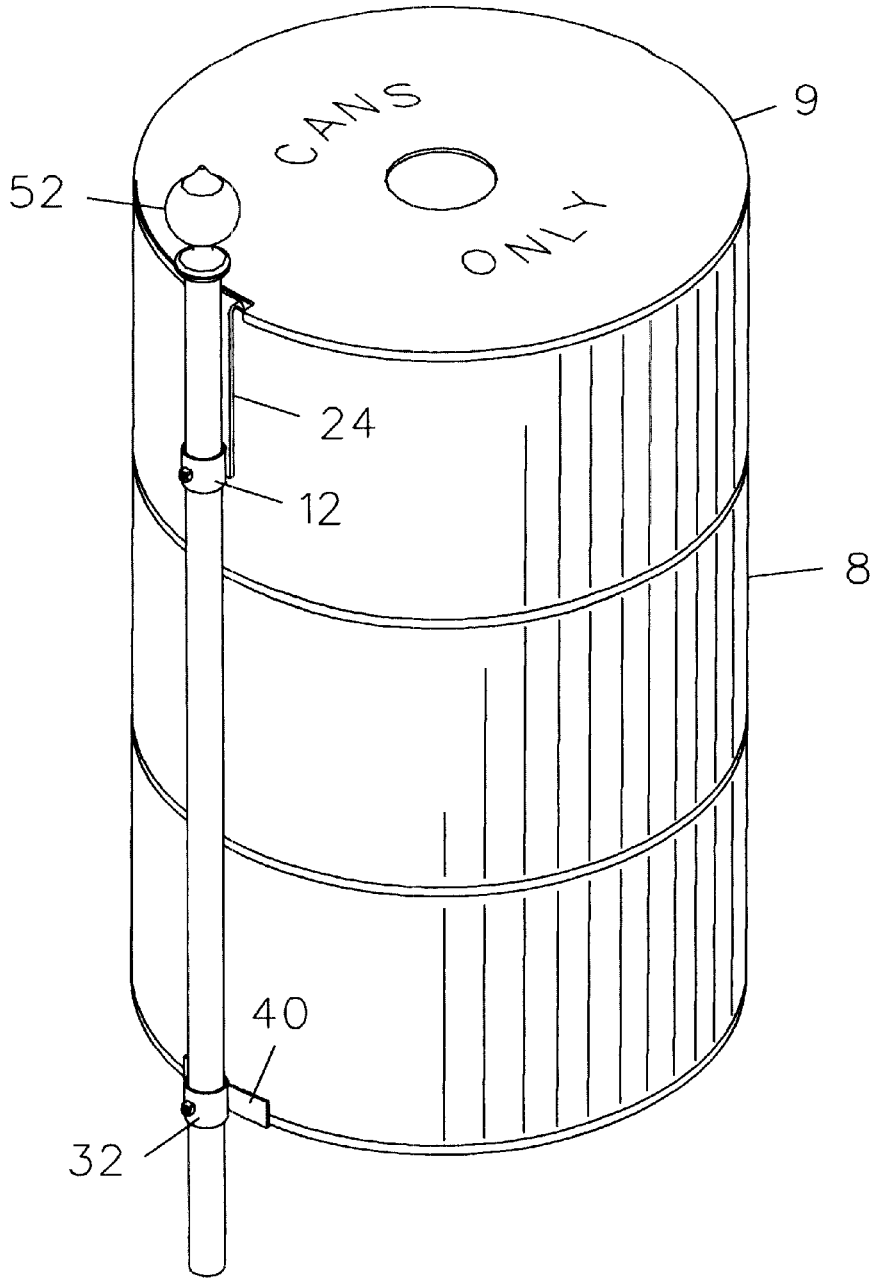
FIG. 4 is a perspective view of the apparatus as in FIG. 3 engaged with a trash receptacle having a lid.

Another embodiment of an apparatus 50 for holding a trash receptacle is shown in FIG. 3 and is substantially similar to the embodiment previously described except as specifically noted below. This embodiment of the apparatus 50 includes a cap member 52 which may be fixedly attached to a top side of a support post 6. The cap member 52 includes an ornamental configuration dimensioned to prevent unauthorized removal of first 12 and second 32 collars. Alternatively, the cap member 52 may be releasably mounted to the support post 6 so that authorized users may remove selected collars by first removing the cap member 52. FIGS. 3 and 4 are also illustrative of how the collars may be configured for use on a support post having a cylindrical configuration.

It should be appreciated that either embodiment of this invention may be used to support and hold trash receptacles having a lid 9, such as those used to collect aluminum cans (FIG. 4). For some lidded receptacles, this may require cutting a slot in the lid to allow the clip 24 to engage the upper rim of the trash receptacle while the clip may engage the rim without any modification of the lid in other receptacle designs. Further, it should be obvious that multiple sets of collars coupled to a single post would enable multiple trash receptacles to be supported about a single post.

Having thus described the invention, what is claimed as new and desired to be secured by Letters Patent is as follows:

1. An apparatus for holding a trash receptacle so that it is not easily tipped over, comprising:

an elongate support post adapted to be mounted upright in and extending upwardly from a ground surface;

a first collar coupled to said support post and adapted to be slidably moved and selectively positioned therealong;

a downwardly opening clip attached to said first collar and adapted to engage an upper rim of the trash receptacle;

a second collar coupled to said support post and adapted to be slidably moved and selectively positioned therealong;

bracket attached to said second collar and adapted to support a lower rim of the trash receptacle, said bracket including an annular rear wall adapted to bear against a side wall of the trash receptacle and an annular bottom wall normal to said rear wall adapted to support the lower rim of the trash receptacle; and a rounded annular bar member fixedly attached to said bottom wall and spaced from said rear wall, said bottom bar adapted to selectively mate with the lower rim of the trash receptacle, whereby to prohibit undesired movement or removal.

2. The apparatus as in claim 1 wherein said support post is constructed of iron tubing having a square configuration.

3. The apparatus as in claim 1 wherein said first collar defines a first bore having a plurality of threads therealong, said apparatus further comprising a first screw fastener configured to threadably mate with said first bore, whereby said first collar is frictionally tightened against said post upon rotation of said first screw fastener in said first bore.

4. The apparatus as in claim 3 wherein said second collar defines a second bore having a plurality of threads therealong, said apparatus further comprising a second screw fastener configured to threadably mate with said second bore, whereby said second collar is frictionally tightened against said post upon rotation of said second screw fastener in said second bore.

5. The apparatus as in claim 1 wherein said second collar defines a second bore having a plurality of threads therealong, said apparatus further comprising a second screw fastener configured to threadably mate with said second bore, whereby said second collar is frictionally tightened against said post upon rotation of said second screw fastener in said second bore.

6. The apparatus as in claim 1 wherein said clip includes a generally inverted U-shaped configuration having first and second portions with an angular portion intermediate said first and second portions, said first portion extending upwardly from said first collar and having a length greater than a length of said second portion, said second portion extending downwardly from said angular portion, said clip adapted to selectively capture the upper rim of the trash receptacle between said first and second portions of said clip.

7. The apparatus as in claim 1 further comprising a cap member attached to a top of said post and configured to prevent removal of said first and second collars from said post.

8. An apparatus for holding a cylindrical trash receptacle so that it is not easily tipped over or removed, comprising:

an elongate support post adapted to be mounted upright in a ground surface and to extend upwardly therefrom;

a first collar slidably coupled to said support post and adapted to be selectively positioned therealong;

a downwardly opening clip fixedly attached to said first collar, said clip having a generally U-shaped configuration and having first and second portions with an angular portion connecting said first and second portions, said first portion extending upwardly from said first collar and having a length greater than a length of said second portion, said second portion extending downwardly from said angular portion such that the upper rim of the trash receptacle may be selectively captured between said first and second portions of said clip;

a second collar slidably coupled to said support post and adapted to be selectively positioned therealong below said first collar;

a platform member attached to said second collar for supporting a lower rim of the trash receptacle, said platform member including an L-shaped flange constructed of angle iron and having an annular configuration;

a rounded annular bar member fixedly attached to said L-shaped flange, and configured to selectively mate with the lower rim of the trash receptacle, whereby to prevent the trash receptacle from being dislodged from said platform member; and a cap member fixedly attached to a top of said post for selectably precluding removal of said first and second collars from said post.

9. The apparatus as in claim 8 wherein said first collar defines a first bore having a plurality of threads therealong, said apparatus further comprising a first screw fastener configured to threadably mate with said first bore, whereby said first collar is frictionally tightened against said post upon rotation of said first screw fastener in said first bore.

10. The apparatus as in claim 9 wherein said second collar defines a second bore having a plurality of threads therealong, said apparatus further comprising a second screw fastener configured to threadably mate with said second bore, whereby said second collar is frictionally tightened against said post upon rotation of said second screw fastener in said second bore.

11. The apparatus as in claim 8 wherein said second collar defines a second bore having a plurality of threads therealong, said apparatus further comprising a second screw fastener configured to threadably mate with said second bore, whereby said second collar is frictionally tightened against said post upon rotation of said second screw fastener in said second bore.

* * * * *